United States Patent [19]

Kochanowsky

[11] 4,103,972

[45] Aug. 1, 1978

[54] OPEN PIT MINE

[76] Inventor: Boris J. Kochanowsky, c/o Synnestvedt & Lechner, 12 S. 12th St., Philadelphia, Pa. 19107

[21] Appl. No.: 705,508

[22] Filed: Jul. 15, 1976

Related U.S. Application Data

[63] Continuation-in-part of Ser. No. 420,886, Dec. 3, 1973, Pat. No. 3,975,053.

[51] Int. Cl.[2] ..... E21D 1/03; E21F 13/00; E21C 41/06

[52] U.S. Cl. ..... 299/18; 299/19

[58] Field of Search ..... 299/7, 18, 19, 10

[56] References Cited

U.S. PATENT DOCUMENTS

| | | | |
|---|---|---|---|
| 3,098,641 | 7/1963 | Baldwin | 299/18 |
| 3,349,848 | 10/1967 | Burgh | 299/18 |
| 3,586,379 | 6/1971 | Lambly | 299/19 |
| 3,692,364 | 9/1972 | Henriksson | 299/18 |
| 3,975,053 | 8/1976 | Kochanowsky | 299/18 |

OTHER PUBLICATIONS

"Portable Crusher for Open Pit and Quarry Operations," B. J. Kochanowsky, *Mining Engineering,* Dec. 1960, pp. 299–318.

*Primary Examiner*—Ernest R. Purser
*Assistant Examiner*—William F. Pate, III
*Attorney, Agent, or Firm*—M. Richard Page

[57] ABSTRACT

This invention relates to novel configurations of open pit mines and methods of mining in open pit operations in which the benches are established radially outward from a turning point to facilitate the use of a mobile crusher adjacent the benches in combination with a belt conveyor system that can carry crushed mined mineral materials directly from the mobile crusher and deliver them directly to the turning point area.

10 Claims, 18 Drawing Figures

(a) SURFACE MINING WITH CONVENTIONAL EQUIPMENT (b) SURFACE MINING WITH MOBILE CRUSHER AND CONVEYORS

OPEN PIT MINE

This application is a continuation-in-part of my copending application Ser. No. 420,886, filed Dec. 3, 1973 now U.S. Pat. No. 3,975,053.

This invention relates to novel configurations of open pit mines and methods of mining in open pit operations so that mobile crushing apparatus can be located adjacent the benches and the crushed mined mineral materials can be delivered from the crusher to a materials-handling and discharge point by means of a belt conveyor system. In one of the preferred embodiments, called the "screw-mining method," radial-rotating benches are established to move on a downwardly-sloping screw-shaped path. In another embodiment, the radial-rotating benches move in a horizontal plane.

The screw-mining method comprises one or several benches which are positioned radially with respect to a turning point area about which they rotate, moving on a downwardly sloping screw-shaped path. If the turning point is located adjacent the periphery of the mining field, mined mineral material may be removed from the turning point area by means of one or more conveyors. If the turning point is located at a central point in the mining field, then one or more vertical or inclined shafts are located in the turning point area. Mineral material mined from the benches is hauled to these shafts where it creates a buffer in the haulage system. Mineral material of different quality may be deposited separately in different shafts (or conveyors). These mined materials are either blended during the emptying of these shafts or transported separately to some further destination through one or several horizontal and/or inclined tunnels. These tunnels connect the bottom of the shafts with the earth's surface.

In the case where several high benches are mined simultaneously with one shaft or with one set of shafts, the slope of the floor, where equipment must stand and move near the shafts within the turning point area, may become quite steep. It is therefore more convenient to mine mineral materials within this small area (interior zone) not through benches which are moving on downwardly sloping screw-shaped paths, but with any method which allows the floor or the turning point area to be kept more or less horizontal.

Both methods, as such and combined with equipment, are suitable for use in open pit mining for extraction of rock, ore and other mineral materials excavated from the earth's crust.

During the last two decades, more than fifty plants which utilize a "mobile crusher-conveyor system" have been introduced in surface mining in many countries. By crushing the rock or ore before hauling, this system replaces trucks with belt conveyors, thereby permitting a continuous, almost fully automated operation, with all of its attendant advantages. Compared with conventional methods and equipment now used in surface mining, the mobile crusher-conveyor system is able to increase the drastically man-hour output, to reduce the power consumption and maintenance of hauling equipment, and thus to reduce the cost of operation significantly. Foggy weather or icy roads, which can make trucking extremely hazardous or even impossible, has no effect on belt conveyor haulage. However, plants with mobile crusher-conveyor systems have been well adapted for open pit mines which operate only one bench and mine mineral material of only one quality. When several benches are mined simultaneously with conventional methods, the open pit mines have a circular or elliptical shape. The use of a mobile crusher-conveyor system in such mines requires prohibitive investment for belt conveyors. Furthermore, the mobile crusher-conveyor system does not have the flexibility which truck haulage offers. Using trucks, material of different quality which must be mined in an open pit can easily be transported from any point in the mine to any different desirable destination. The inventions described and claimed here are able to eliminate these difficulties and to obtain further advantages and objectives.

It is an object of this invention to make mining operations more efficient, permitting drastic cuts in man power and in costs.

Another object is to provide an efficient method of mining where several benches can be mined simultaneously.

Another object is to permit the application of a highly efficient and economic mobile crusher-conveyor system in mines where several benches can be mined simultaneously.

Another object is to provide a method of open pit mining with a mobile crusher-conveyor system which reduces the length of the belt conveyor. Compared with the circular or elliptical shape of the open pit now used in surface mining, the length of the belt conveyor is reduced by the methods claimed herein up to six times and even more.

Another object is to permit mining of mineral materials of different quality.

Another object is to permit blending of mined material of different quality in the mine.

Another object is to provide a buffer in haulage of mined mineral material located between the loading point on the benches and the point of final destination. It will make operation in transportation without costly interruptions and disturbance.

The above-mentioned objects will be evident from the following description of the drawings, in which:

FIG. 1*a* is a cross-sectional view of a conventional surface mining method with conventional equipment;

FIG. 1*b* is a cross-sectional view of a conventional surface mining operation using a mobile crusher-conveyor system;

FIGS. 2*a* and 2*b* are cross-sectional and plan views of a conventional open pit mining method with circular or elliptical multi-benches;

FIG. 3 shows a perspective view of the new mining method of this invention, called a "screw-mining method," with radial-rotating benches moving on a downwardly sloping screw-shaped path, combined with a mobile crusher-conveyor system (one or more vertical and/or inclined shafts can be used with this method);

FIG. 4 shows a perspective view of the screw-mining method of this invention combined with the mobile crusher-conveyor system as it is presented in FIG. 3, but with the following difference: The large exterior zone of the mining field is mined with radial-rotating benches which move on a downwardly sloping screw-shaped path. The small interior zone located near the shafts within the turning point area is mined with any other mining method which allows the floor where equipment stands and moves to be kept horizontal.

Figure 7A:
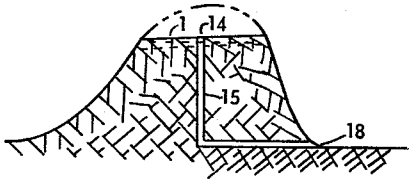
Figure 7B:
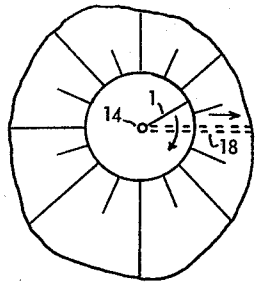
Figure 8A:
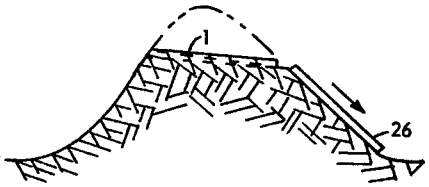
Figure 8B:
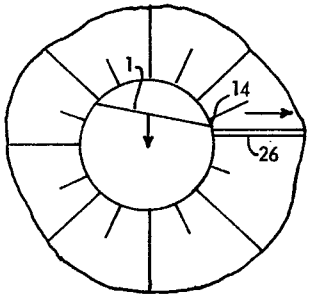
Figure 3:
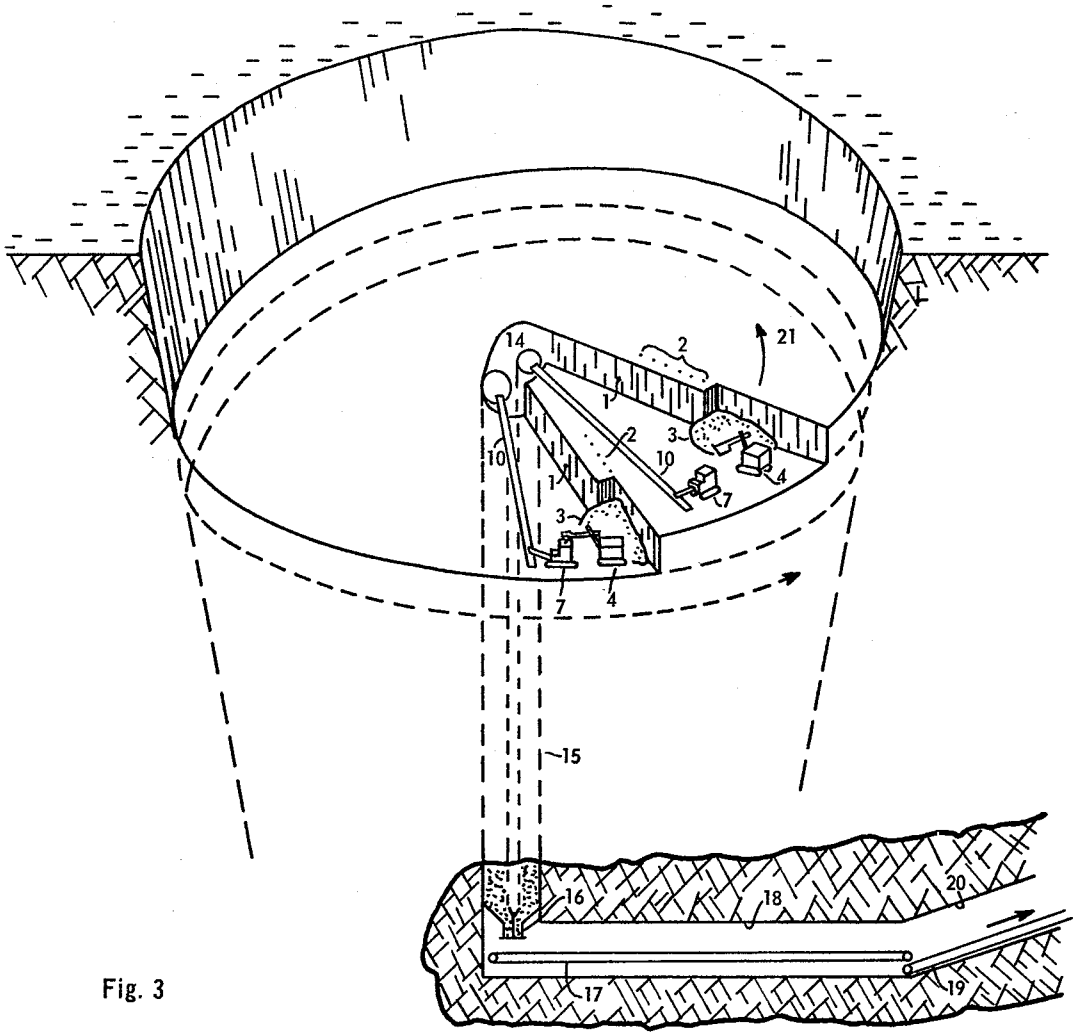
Figure 4:
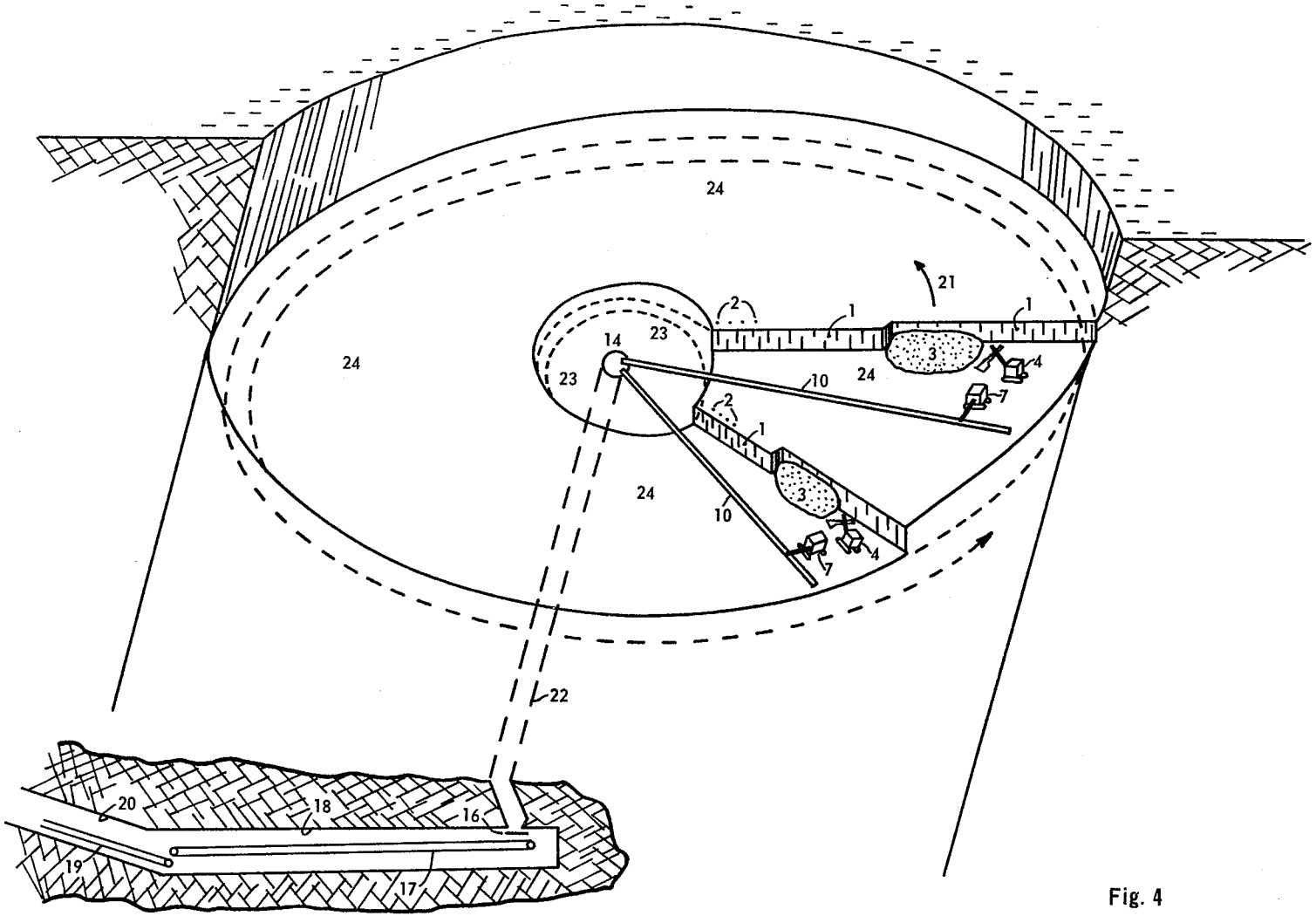
Figure 5:
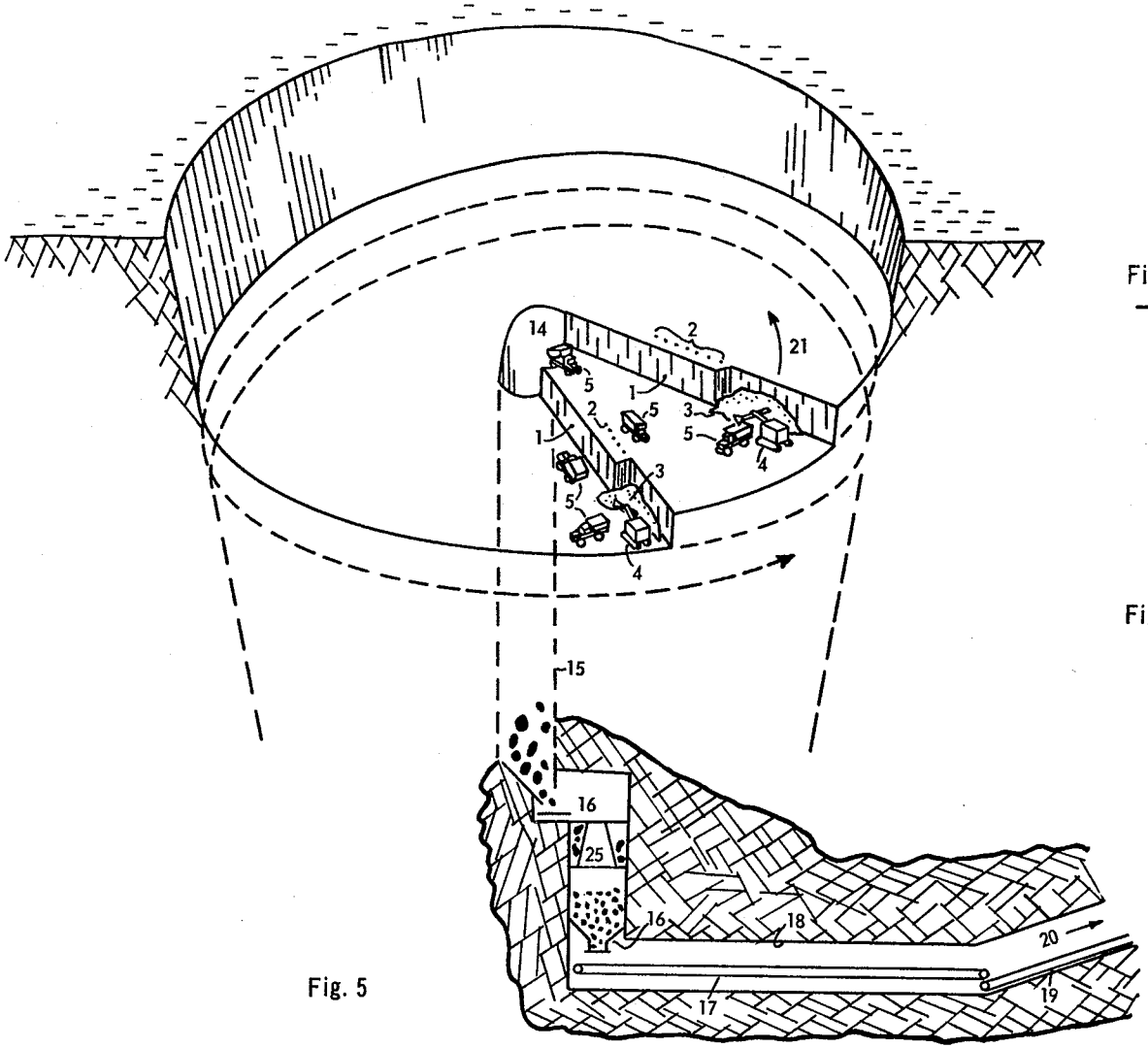
FIG. 5 is a perspective view of the screw-mining method combined with conventional equipment.

FIGS. 7*a* and 7*b* are cross-sectional and plan views of the methods shown in FIGS. 3, 4 and 5 applied to the mining of a hill or mountain with a bench rotation of 360°, using a shaft and tunnel for transportation of mined material;

FIGS. 8*a* and 8*b* are cross-sectional and plan views of the methods shown in FIGS. 3, 4 and 5 with a bench rotation of less than 360°, working without shaft and tunnel. The means of material transport are placed on the surface of the hill.

Figure 9A:
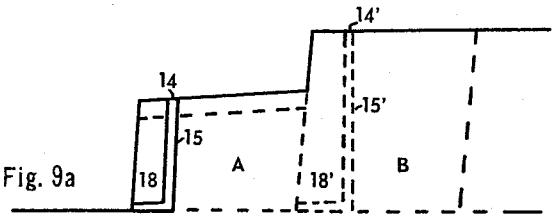
Figure 9B:
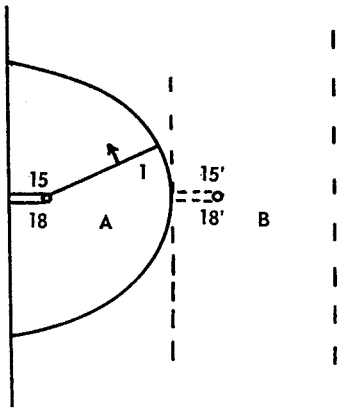

FIGS. 9*a* and 9*b* are cross-sectional and plan views of methods shown in FIGS. 3, 4 and 5 applied for mining of a large mining area with a short tunnel. After the mining field A is mined, a new tunnel in the mining field B is built to mine mineral material in this region.

Figure 10A:
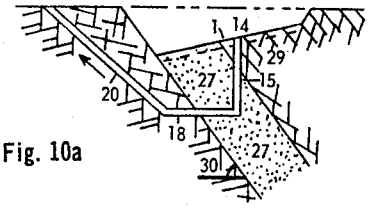
Figure 11A:
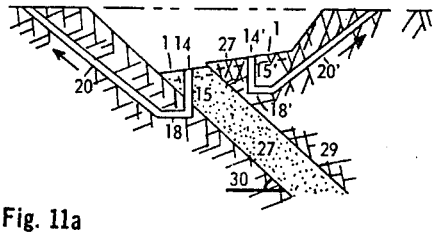
Figure 10B:
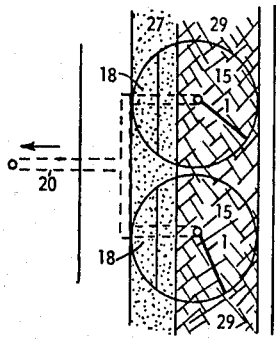
Figure 11B:
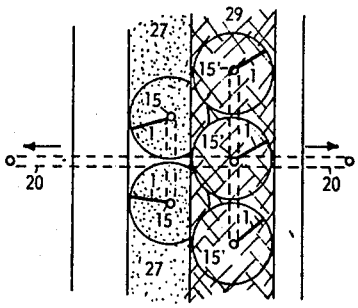

FIGS. 10*a* and 10*b* are cross-sectional and plan views of the methods shown in FIGS. 3, 4 and 5 where mining of ore and steril material of the mining field occurs with the same shaft or set of shafts;

FIGS. 11*a* and 11*b* are cross-sectional and plan views of the methods shown in FIGS. 3, 4 and 5 where mining of ore and steril of the mining field occurs with a completely separate shaft or set of shafts and the horizontal and/or inclined tunnels belonging to them.

FIGS. 3 to 11 show a mining area having a circular shape, but it will be understood that an area can have other shapes.

Figure 1A:
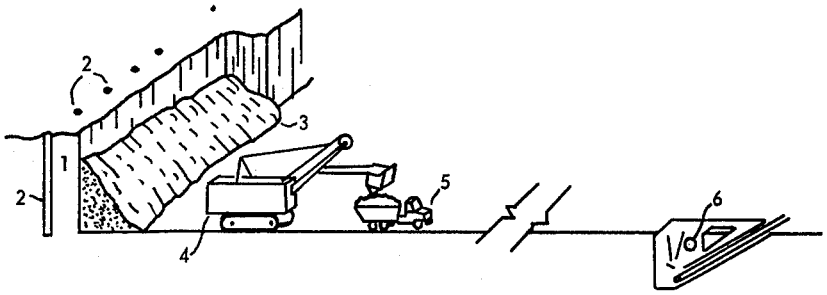
Fig. 1a PRIOR ART

The mining art prior to this invention may be seen by referring to the drawings, and in particular to FIG. 1*a* where there is shown a cross-sectional view of a surface mining with conventional equipment. In hard rock, bench 1 is blasted with explosives which fill borehole 2 drilled in this rock. Blasted material in a pile 3 is loaded by a loading machine 4 into a truck 5 which transports this material to a stationary crusher 6. Crushed material is transported to rock storage or to a treatment plant where raw material is converted into a commercial product.

Figure 1B:
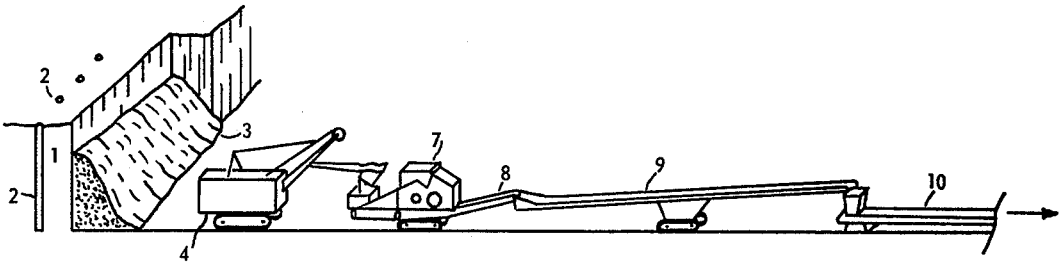
Fig. 1b PRIOR ART

FIG. 1*b* shows a cross-sectional view of a surface mining operation where a mobile crusher-conveyor system is used. Here blasted material from pile 3 is loaded by a loading machine into mobile crusher 7. Crushed material is deposited by a swinging conveyor 8 which is attached to the mobile crusher 7 either to a bridge conveyor 9 or directly to a stationary or semi-stationary conveyor 10. Conveyor 10 transports crushed material to a rock storage or to a treatment plant.

Figure 2A:
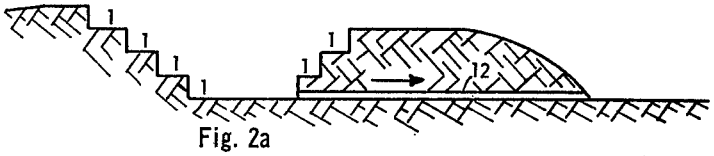
Figure 2B:
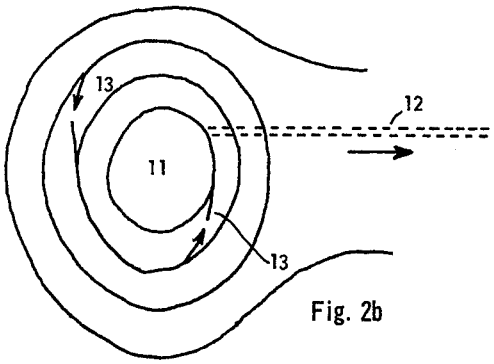

FIG. 2*a* shows a cross-sectional view and FIG. 2*b* a plan view of an open pit mine. Mineral material mined from benches 1 are moving from the middle point 11 or middle axis of the pit to the outside toward the limits of the mining field or towards the limits of the mineral deposit. The shape of the face of these benches 1 is mostly circular or elliptical, not easily adaptable for the use of belt conveyors which must be straight.

Transportation of mined material from benches 1, which lack direct exit due to the topography of the country, occurs through tunnel 12. To reach this tunnel 12, mined material is transported down from bench to bench which are connected with sloped roads 13.

Even in the case when a group of two or three benches are operated with a single main conveyor located on one of these benches and which is connected with other benches by means of bridge conveyors 9, such a pit would need many long, very expensive conveyors and bridge conveyors. The required investment for such installation would be prohibitive. Most of the open pit mines are hauling mineral material of different grades separately from different loading points to several places or to a point where mineral material of different grades is blended. This requirement would create serious difficulties for the mobile crusher-conveyor system if applied to conventional mining methods now used in surface mining.

The invention presented here permits one to overcome all mentioned difficulties in the best way. Compared to the circular or elliptical shape of bench faces, the total length of conveyors for a screw-mined pit will be six or more times shorter. The operation of such a mine also permits maximum efficiency in cases when blending of material extracted is required. Following one embodiment of this invention, the movement of a bench or bench faces takes place in the form of a downwardly directed "screw" or "spiral" and therefore this method of mining is referred to in this specification and the appended claims as the "screw-mining method" or "spiral-mining method." FIG. 3 shows a perspective view of a screw-mining method combined with a "mobile crusher-conveyor system."

The screw-mining method comprises one or several benches which may be mined simultaneously and are radially positioned with respect to a turning point area about which they rotate in a clockwise or counterclockwise direction 21 moving on a downwardly sloping screw-shaped path. Each bench 1 rotates many times around the turning point area 14 until it reaches its lowest desirable level which could be the bottom of the planned mining field. The development of a new bench 1 after each rotation of 360° is therefore not required. The costs for development of a new bench and for the moving of all equipment from the old to the new bench are saved. Inconveniences associated with the development of a new bench will not occur.

Depending upon the geological, mining and economic conditions, one or several vertical or inclined shafts are located in the turning point area. When a mineral deposit dips into the earth's crust under a certain angle as it is shown in FIG. 4, it may be more advantageous to use an inclined shaft 22 instead of a vertical one. An inclined shaft may permit the shaft opening, through which mining material is transported, always to be kept close to the center of a mining field. Therefore, one can use the same length of belt conveyor placed parallel to the bench for the entire time.

The conveyor 10 is usually placed parallel to the bench 1 and the mobile crusher 7 is moved between the bench 1 and the conveyor 10. Mineral material blasted with boreholes 2 is loaded from pile 3 by a loading machine 4 into the mobile crusher 7. A mechanical shovel, front loader or any other type of loading machine may be used in the system described. The crusher 7 discharges the broken material onto conveyor 10 which transports it to the turning point area 14 where one or more vertical shafts 15 or inclined shafts 22 or other means of transportation are located. Mineral material of different quality can be deposited in different shafts. At the bottom of these shafts 15 and 22, mined material is taken out by a feeder 16 and is either blended and transported through tunnels 18 and 20 to a further destination or transported separately by different means of transportation through the tunnel and blended in another place. Depending upon the topography which surrounds the mineral deposit, the tunnel of transportation may be horizontal 18 or inclined 20 or both until it reaches the earth's surface.

After bench 1 has been advanced for a certain distance, the conveyor 10 which continuously follows bench 1 must be moved so that it can be easily reached by a mobile crusher 7 and so that this crusher can be reached by a loading machine 4. Since this conveyor 10 is displaced from time to time, it may be called a semi-stationary conveyor. To avoid the need for frequent displacements of the semi-stationary conveyor 10, one or several bridge conveyors 9 (FIG. 1*b*) may be used. They are placed between the semi-stationary conveyor 10 and mobile crusher 7. Bridge conveyors 9 are mounted on wheels or crawlers and therefore can be moved easily.

The inclination of the floor 24 where the loading machine 4, mobile crusher 7 and belt conveyor 10 stand and move depends upon the distance between the working place of this equipment and the turning point 14 of the bench where one or more shafts 15 and 22 are located (FIG. 4). It depends also upon the number of benches and their height. The shorter the distance between the working place of the equipment and shaft, the greater the number of benches; the higher the benches, then the steeper is the floor. Near the shaft within the turning point area 23, the steepness of the floor may, in certain cases where many high benches are mined simultaneously with one set of shafts, be so great that it will not be easy to operate and move equipment at this place. For this reason, the whole mining area, as it is shown in FIG. 4, is divided into two zones — exterior zone 24 and interior zone 23. The exterior zone 24 is mined with a screw-mining method where benches rotate around the shaft and move in a downwardly sloping screw-shaped path. The interior zone 23 is mined with any other conventional method which permits the floor, where equipment stands and moves, to be kept more or less horizontal. The area of the interior zone 23 is usually small, several hundred feet in diameter. The exterior zone 24 is large and may be several miles in diameter. Interior and exterior zones may be circular or any other shape.

FIG. 5 shows a perspective view of a screw-mining method combined with conventional equipment. In this case, mineral material must either have special geological characteristics, such that it breaks easily into small pieces during its extraction, or it must be mined in such a way that it can be loaded on the belt conveyor and transported through the tunnel without damaging the belt, or the mined material must be broken by a crusher 25 installed at the bottom of the shaft before it is loaded on the belt conveyor in the tunnel. In case a crusher is not available, other means of transportation instead of a belt conveyor must be used in the tunnel.

Figure 6:
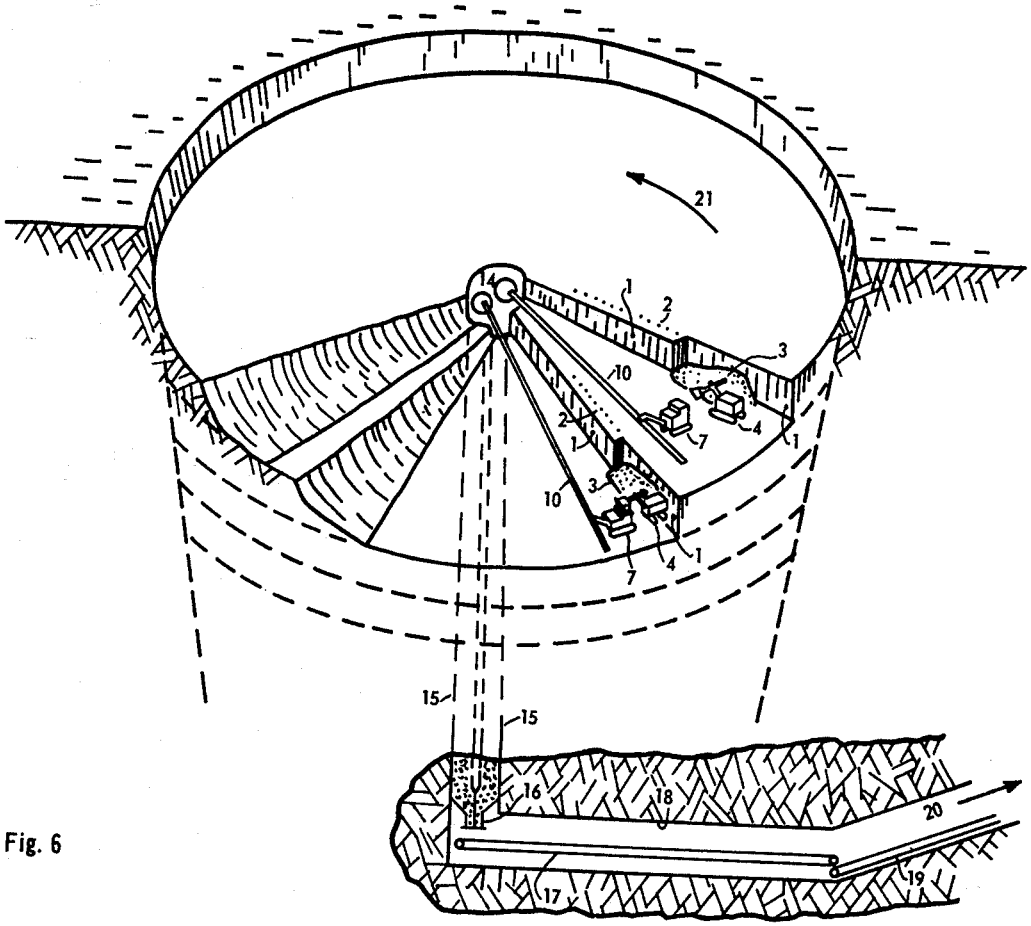
FIG. 6 is a perspective view of a mining method with radial-rotating benches which move in a horizontal plane, combined with a mobile crusher-conveyor system.

FIG. 6 shows a perspective view of a mining method with radial-rotating benches moving in a horizontal plane with a mobile crusher-conveyor system. Two vertical shafts 15 are shown in this Figure. The operation of this method combined with equipment is similar to that described in FIG. 3. However, after the bench has rotated 360°, it ceases to exist and a new bench on a lower level must be developed and all equipment moved to the new branch, which is costly.

The application of the instant invention is simplest when the mineral deposit has the shape of a hill or mountain and can be entirely extracted. All operations in these cases occur in the ore body itself and the removing of overburden through a stripping operation is not required. These cases are illustrated in FIGS. 7*a* and 8*a*, showing the cross-sectional view, and in FIGS. 7*b* and 8*b* showing a plan view.

In FIGS. 7*a* and 7*b*, bench 1 is turning 360° around the turning point area 14. Mined mineral material is transported through shaft 15 and tunnel 18. Depending on the size of the mountain, its extraction can be accomplished with one or with several independent sets of shafts located in different turning point areas 14.

In order to save the cost of building shafts 15 located in turning point area 14 and the tunnel 18, both located within the mineral deposit, the hauling equipment 26, which serves the same purpose, may be placed on the surface of the natural slope of the mountain, which can be adapted to this goal if required (FIGS. 8*a* and 8*b*).

When a mineral deposit of large three-dimensional extent must be mined, this deposit may be divided into several mining fields, each of them having either one shaft or a group of shafts in a turning point area. Pure economics based on feasibility studies will determine the horizontal and vertical dimension and shape of each mining field belonging to each shaft or to each set of shafts, or whatever other means are used to transport mined material usually downwards. Similarly, the decision must be made concerning the question of how many mining field units are required to extract the whole deposit and what the sequence of operation of these mining field units will be.

As it is shown in FIGS. 7*a*, 7*b*, 8*a* and 8*b*, the shaft 15 and tunnel 18 can be saved by placing the hauling equipment 26 directly on the earth's surface adapted for this purpose. This is possible to do either close to the outcrop of the mineral deposit or on the border of the mining field in case the adjacent mining field has been previously mined completely.

To save a part of tunnel 18, a short tunnel may be used, as indicated in FIG. 9*a* which shows a cross-sectional view and FIG. 9*b* which shows a plan view. The length of belt conveyor 10 on the bench must be adjusted to the changing length of the bench during its rotation. After mining field A is mined, a short tunnel 18' in mining field B can be developed to mine this field.

FIG. 10*a* gives a cross-sectional view and FIG. 10*b* a plan view of a mineral deposit which dips under a certain angle 30 in the earth's crust. In these Figures, the commercially useful mineral 27 and steril 29 are mined with the same shaft 15 or set of shafts placed in the turning point area 14. In case only one shaft is available, it must be emptied first before the type of material (useful or steril) which is mined and transported through this shaft is changed. Useful mineral and steril is transported through shaft 15, tunnel 18 and inclined drift 20.

To make operation in transportation simpler, it is more convenient to have at least two shafts located in turning point area 14, one or useful mineral and another for steril.

A more simplified operation but more costly arrangement is presented in FIG. 11*a* which shows a cross-sectional view and FIG. 11*b* which shows a plan view. As can be seen from these Figures, the mining of useful mineral 27 and of steril 29 utilizes completely separate shafts and tunnels. Transportation of useful minerals 27 takes place through shaft or shafts 15, tunnel 18 and inclined drift 20, and transportation of steril occurs through shaft or shafts 15', tunnel 18' and inclined drift 20'.

Material transported through shafts 15 and 15' can be transported through one tunnel and tunnel 18' and inclined drift 20′ eliminated. The bottom of both shafts must be located on the same level in this case.

I claim:

1. An open pit mine for the extraction of mineral materials from the earth's crust comprising:

a turning point area having a substantially horizontally level floor adapted to facilitate the operation of material-handling equipment and to receive crushed mined mineral material;

at least one bench moving on a downwardly sloping screw-shaped path extending radially outward from the turning point area;

a mobile crusher for crushing mined mineral materials located adjacent the bench;

a belt conveyor system for conveying crushed mined mineral materials from the crusher to the turning point area; and means for discharging the crushed mined mineral materials downwardly from the turning point area.

2. A mine according to claim 1 in which the means for discharging the crushed mineral materials from the turning point area is at least one generally downwardly directed vertical or inclined shaft.

3. A mine according to claim 1 in which the means for discharging the crushed mineral materials from the turning point area are a plurality of downwardly directed shafts for receiving mined mineral materials of different quality.

4. A mine according to claim 3 in which blending means are established adjacent the discharge end of the downwardly directed shafts.

5. A method of open pit mining for the extraction of mineral material from the earth's crust comprising:

establishing a turning point area with a substantially horizontally level floor adapted to facilitate the operation of material-handling equipment and to receive crushed mined mineral materials;

developing at least one bench radially outward from the turning point area;

mining the bench on a downwardly sloping screw-shaped path;

loading mined minerals materials into a mobile crusher and crushing the mined mineral materials adjacent the bench;

transporting the crushed mined mineral materials to the turning point area by a conveyor belt system; and discharging the mined mineral materials in a generally downwardly extending direction from the turning point area.

6. A method according to claim 5 in which the crushed mined mineral material is discharged through at least one downwardly directed shaft located at the turning point area.

7. A method according to claim 5 in which mined mineral materials of different quality are transported in sequence "one by one" through one shaft and then by one belt conveyor through a tunnel or inclined drift to a blending station.

8. A method according to claim 5 in which the crushed mine mineral material is discharged from the turning point area through a plurality of downwardly directed shafts adapted to receive mined mineral materials of different quality.

9. A method according to claim 8 in which the mined mineral materials of different quality taken from the plurality of shafts are conveyed on separate belt conveyors through a tunnel or inclined drift to a blending station.

10. A method according to claim 8 in which the discharged mined mineral materials are blended underneath the shafts before further transportation.

* * * * *